US008408014B2

(12) United States Patent
Yuan et al.

(10) Patent No.: US 8,408,014 B2
(45) Date of Patent: Apr. 2, 2013

(54) VARIABLE PHASE SHIFT DEVICES FOR PULSE TUBE COOLERS

(75) Inventors: Sidney W. K. Yuan, Los Angeles, CA (US); David G. T. Curran, Pacific Palisades, CA (US)

(73) Assignee: The Aerospace Corporation, El Segundo, CA (US)

( * ) Notice: Subject to any disclaimer, the term of this patent is extended or adjusted under 35 U.S.C. 154(b) by 634 days.

(21) Appl. No.: 12/611,774

(22) Filed: Nov. 3, 2009

(65) Prior Publication Data

US 2011/0100023 A1 May 5, 2011

(51) Int. Cl.
*F25B 9/00* (2006.01)

(52) U.S. Cl. ..... 62/6

(58) Field of Classification Search ..... 62/6, 55.5, 62/132, 335, 527

See application file for complete search history.

(56) References Cited

U.S. PATENT DOCUMENTS

| | | | | |
|---|---|---|---|---|
| 5,295,355 | A | 3/1994 | Zhou et al. | |
| 5,412,952 | A | 5/1995 | Ohtani et al. | |
| 5,953,920 | A | 9/1999 | Swift et al. | |
| 6,314,740 | B1 * | 11/2001 | De Blok et al. | 62/6 |
| 6,983,610 | B1 | 1/2006 | Olson | |
| 7,143,586 | B2 * | 12/2006 | Smith et al. | 62/6 |
| 7,347,053 | B1 | 3/2008 | Haberbusch et al. | |
| 2006/0026968 | A1 * | 2/2006 | Gao | 62/6 |
| 2007/0000257 | A1 | 1/2007 | Mita et al. | |
| 2007/0157632 | A1 * | 7/2007 | Saito | 62/6 |
| 2009/0084114 | A1 | 4/2009 | Yuan et al. | |
| 2009/0084115 | A1 | 4/2009 | Yuan et al. | |
| 2009/0084116 | A1 | 4/2009 | Yuan et al. | |
| 2009/0107150 | A1 | 4/2009 | Yuan et al. | |
| 2009/0241556 | A1 * | 10/2009 | Mingyao | 62/6 |
| 2011/0100022 | A1 | 5/2011 | Yuan et al. | |
| 2011/0100024 | A1 | 5/2011 | Yuan et al. | |

FOREIGN PATENT DOCUMENTS

JP 08271070 A 10/1996

OTHER PUBLICATIONS

Notice of Allowance issued on Sep. 19, 2012 in U.S. Appl. No. 12/611,764.

Restriction Requirement issued on Jul. 20, 2012 in U.S. Appl. No. 12/611,784.

Non-Final Action issued on Aug. 31, 2012 in U.S. Appl. No. 12/611,784.

Ray Radebaugh, "Development of the Pulse Tube Refrigerator as an Efficient and Reilable Cryocooler," submitted to Proc. Institution of Refrigeration (London), 1999-2000, downloaded from cryogenics.nist.gov/Papers/Institute_of_Refrig.pdf on Nov. 3, 2009.

Gunther Cronenberg, "The Stirling Engine," Mar. 28, 2005, downloaded from cronenberg.cc/gunther/Skripten/Stirling/stirling.pdf on Nov. 3, 2009.

* cited by examiner

*Primary Examiner* — Melvin Jones
(74) *Attorney, Agent, or Firm* — K & L Gates LLP

(57) ABSTRACT

Various embodiments are directed to pulse tube coolers having flow resistance devices that are variable within the thermodynamic cycle of the pulse tube. An example pulse tube may comprise a compressor, a regenerator, a reservoir and a pulse tube. A working fluid may be positioned within the regenerator, pulse tube and reservoir. Further, a variable phase control device may be positioned in a fluid path between the pulse tube and the reservoir. The pulse tube cooler may also comprise a control circuit. The control circuit may be programmed to vary a characteristic of the variable phase control device based on the position of the pulse tube cooler in its thermodynamic cycle.

23 Claims, 16 Drawing Sheets

VARIABLE PHASE SHIFT DEVICES FOR PULSE TUBE COOLERS

RELATED APPLICATIONS

This application is related to the following applications, which are incorporated herein by reference in their entirety:

(1) U.S. application Ser. No. 12/611,764, entitled, "PHASE SHIFT DEVICES FOR PULSE TUBE COOLERS," and filed on even date herewith; and (2) U.S. application Ser. No. 12/611,784, entitled, "MULTISTAGE PULSE TUBE COOLERS," and filed on even date herewith.

BACKGROUND

Mechanical coolers are devices used for cooling, heating, and thermal transfer in various applications. For example, mechanical coolers are used to cool certain sensor elements, to cool materials during semiconductor fabrication, and to cool superconducting materials such as in Magnetic Resonance Imaging (MRI) systems. Mechanical coolers typically utilize a thermodynamic cycle (often involving the compression and expansion of a fluid) to shift heat and create cold portions that are useful for cooling. Cryocoolers are a class of mechanical coolers that can achieve cold temperatures in the cryogenic range (e.g., <~123 K). Different types of mechanical coolers may comprise various valves, thermal compressors, mechanical compressors, displacers, etc., to bring about expansion and compression of the working fluid.

A pulse tube cooler includes a stationary regenerator connected to a pulse tube. A reservoir or buffer volume may be connected to the opposite end of the pulse tube via a phase control device such as a sharp-edged orifice or an inertance tube. The reservoir, pulse tube, and regenerator may be filled with a working fluid (e.g., a gas such as helium). A compressor (e.g., a piston) compresses and warms a parcel of the working fluid. The compressed working fluid is forced through the regenerator, where part of the heat from the compression ($Q_o$) is removed at ambient temperature and stored at the regenerator. The working fluid is then expanded through the pulse tube and the phase control device into the reservoir. This expansion provides further cooling ($Q_c$) that takes place at a cold temperature ($T_c$). The cooling occurs at a cold end of the pulse tube nearest the regenerator. A hot end of the pulse tube farthest from the regenerator collects heat.

Pulse tube cryocoolers do not have moving parts at the cold end, such as displacer pistons or valves. To achieve the desired cooling, the combination of the phase control device and the reservoir cause a phase shift between mass waves and pressure waves generated by the compressor. By restricting or slowing the mass flow to the buffer volume, the phase control device may serve to shift the phase of the mass flow relative to the pressure wave generated by the compressor.

SUMMARY

Various embodiments are directed to pulse tube coolers having flow resistance devices that are variable within the thermodynamic cycle of the pulse tube. An example pulse tube may comprise a compressor, a regenerator, a reservoir and a pulse tube. A working fluid may be positioned within the regenerator, pulse tube and reservoir. Further, a variable phase control device may be positioned in a fluid path between the pulse tube and the reservoir. The pulse tube cooler may also comprise a control circuit. The control circuit may be programmed to determine a position of the pulse tube cooler in its thermodynamic cycle and vary a characteristic of the variable phase control device based on the position of the pulse tube cooler in its thermodynamic cycle. For example, if the phase control device comprises a flow resistive device such as an orifice, the flow resistance of the device may be changed, for example, by changing the diameter of the orifice. If the variable phase control device comprises an inertance tube or gap, the inertance of the device may be varied. (It will be appreciated that varying the inertance of an inertance tube or gap may also vary a flow resistance of the device.)

FIGURES

Various embodiments of the present invention are described here by way of example in conjunction with the following figures, wherein.

DESCRIPTION

Figure 1:
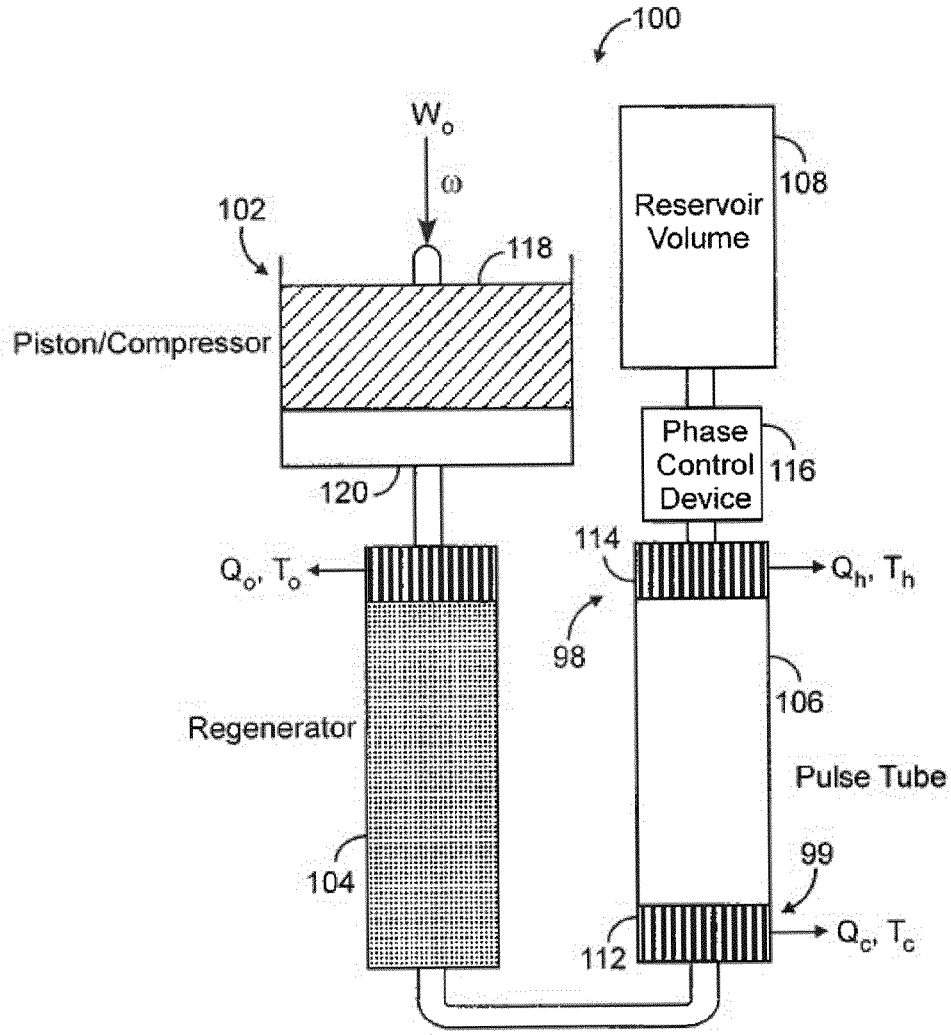
FIG. 1 illustrates one embodiment of a pulse tube cooler.

FIG. 1 illustrates one embodiment of a pulse tube cooler 100. The cooler 100 comprises various components in fluid communication with one another and filled with a working fluid (e.g., helium gas). For example, the cooler 100 may comprise a compressor 102 for providing pressure/volume (PV) work. The compressor 102 may be of any suitable compressor type and, in various embodiments, may be a linear compressor or rotary compressor. In various embodiments, the compressor 102 may comprise a piston 118 and a cylinder 120. In addition, the cooler 100 may comprise a regenerator 104, a pulse tube 106 and a reservoir 108. A first heat exchanger 110 may be positioned between the compressor 102 and the regenerator 104. A cold end heat exchanger 112 may be positioned at a cold end 99 of the pulse tube 106 near the regenerator 104. A hot end heat exchanger 114 is positioned at a hot end 98 of the pulse tube 106 near the reservoir 108. The reservoir 108 and the pulse tube 106 may be connected by a phase control device 116 that may comprise one or more sub-devices having an inertance and/or a resistance to the flow of working fluid, as described below. The phase control device 116 may be embodied as one or more separate components, as a portion of the pulse tube 106, as a portion of the reservoir 108, or as any combination thereof.

The compressor 102, may drive the thermodynamic cycle of the cooler 100 at various frequencies. For example, in various embodiments, one thermodynamic cycle of the cooler 100 may correspond to one complete cycle of the piston 102 or other mechanism of the compressor 102. According to the thermodynamic cycle of the cooler 100, the compressor 102 may provide work $W_o$ to compress a portion of the working fluid, adding heat $Q_o$ and causing the temperature $T_o$ of the working fluid to rise at heat exchanger 110. As the compressor 102 further compresses the working fluid, warm working fluid is passed through the regenerator 104 where part of the heat of compression $Q_o$ is removed and stored. Working fluid already present in the pulse tube 106 may be at a relatively lower pressure than that entering the pulse tube via 106 via the regenerator 104. Accordingly, the working fluid entering the pulse tube 106 via the regenerator 104 may expand in the pulse tube 106, causing cooling Q at the exchanger 112 at a temperature $T_c$. Excess pressure in the pulse tube 106 from the expansion may be relieved across the phase control device 116 into the reservoir. As the cycle continues, the compressor 102 begins to draw the working fluid from the cold end 99 of the pulse tube 106 back through the regenerator 104, where the stored heat is reintroduced. Resulting low pressure in the pulse tube 106 also causes working fluid from the reservoir 108 to be drawn across the phase control device 116 into the pulse tube 106. This working fluid from the reservoir 108 is at a higher pressure than that already in the pulse tube 106 and, therefore, enters with heat energy $Q_h$ and at a temperature $T_h$ that is relatively warmer than that of the other working fluid in the pulse tube 106. A new cycle may begin as the compressor 102 again reverses and begins to compress the working fluid. Examples of the operation of pulse tube coolers are provided in commonly assigned U.S. Patent Application Publication Nos. 2009/0084114, 2009/0084115 and 2009/0084116, which are incorporated herein by reference in their entirety.

The performance of the pulse tube cooler 100 depends on the generated phase shift between the pressure waves and mass flow waves generated by the compressor 102 in the working fluid. This phase shift is a function of the volume of the reservoir 108 and the inertance and/or flow resistance of the phase control device 116. To achieve optimal performance, the phase shift may be approximately 0°, or slightly negative, such that the mass wave and pressure wave roughly coincide at the coldest portion of the pulse tube 106 (e.g., the cold end 99). According to various embodiments, the mechanical/fluid flow properties causing the phase shift may behave in a fashion analogous to the properties of an inductor-resistor-capacitor (LRC) electronic circuit that cause phase shifts between voltage and current. In the context of the pulse tube cooler 100, resistance is analogous to the flow resistance impedance caused by the phase control device 116. Inductance is analogous to the inertance introduced by the phase control device 116. Capacitance is analogous to the heat capacity of the system and is a function of the geometry of the reservoir 108 and the heat capacity of the working fluid.

Figure 2:
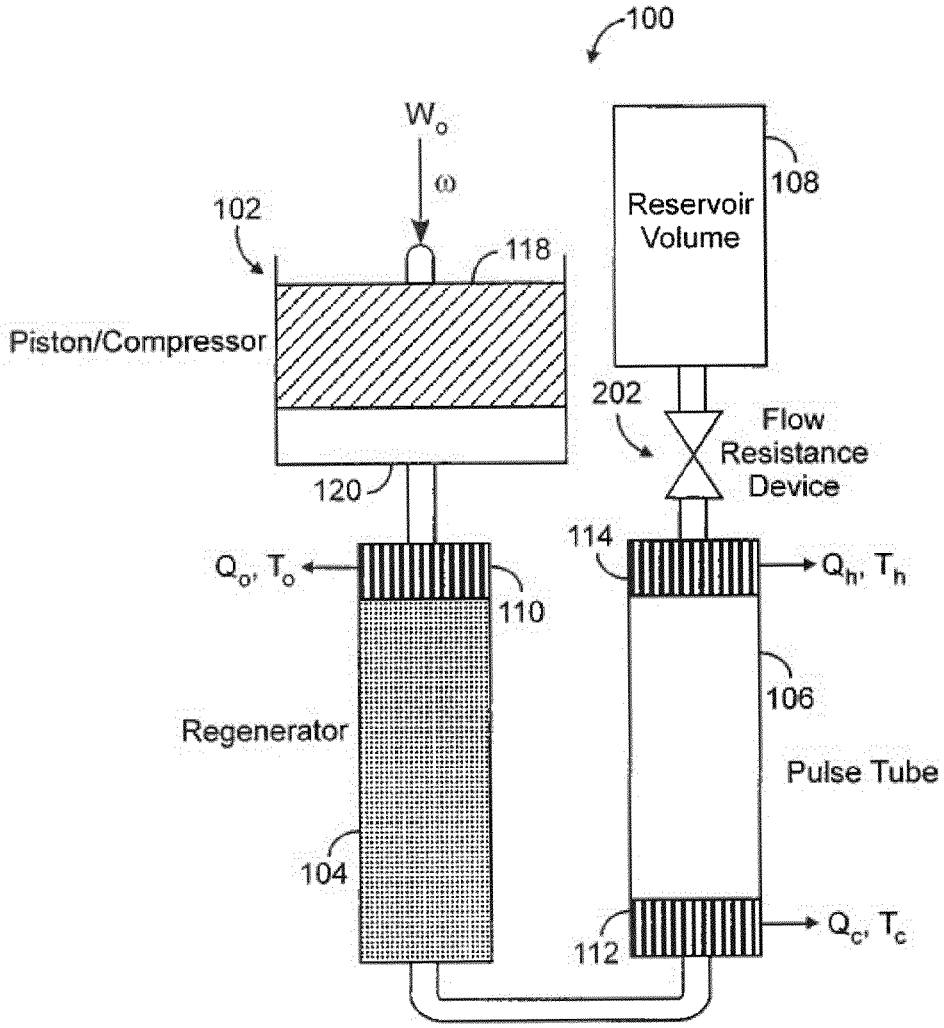
FIG. 2 illustrates one embodiment of the cooler of FIG. 1 where the phase control device comprises an orifice.

According to various embodiments, the phase control device 116 may comprise various components that introduce resistance and or inertance into the system. For example, FIG. 2 illustrates one embodiment of the cooler 100 where the phase control device 116 consists of a flow resistive orifice 202. The orifice 202 resists the flow of working fluid from the pulse tube 106 to the reservoir 108, thus contributing to the phase shift between the pressure wave and mass wave. The flow resistance provided by the orifice 202 may be a function of the size and shape of the orifice. For example, for a circular orifice 202, the resistance may depend on the orifice diameter. The orifice 202 may be embodied as a part of the pulse tube 106, a part of the reservoir 106, a separate component, or any combination thereof. It will be appreciated that a resistive orifice 202 may be associated with an irreversible energy loss that can serve as a drag on efficiency.

Figure 3:
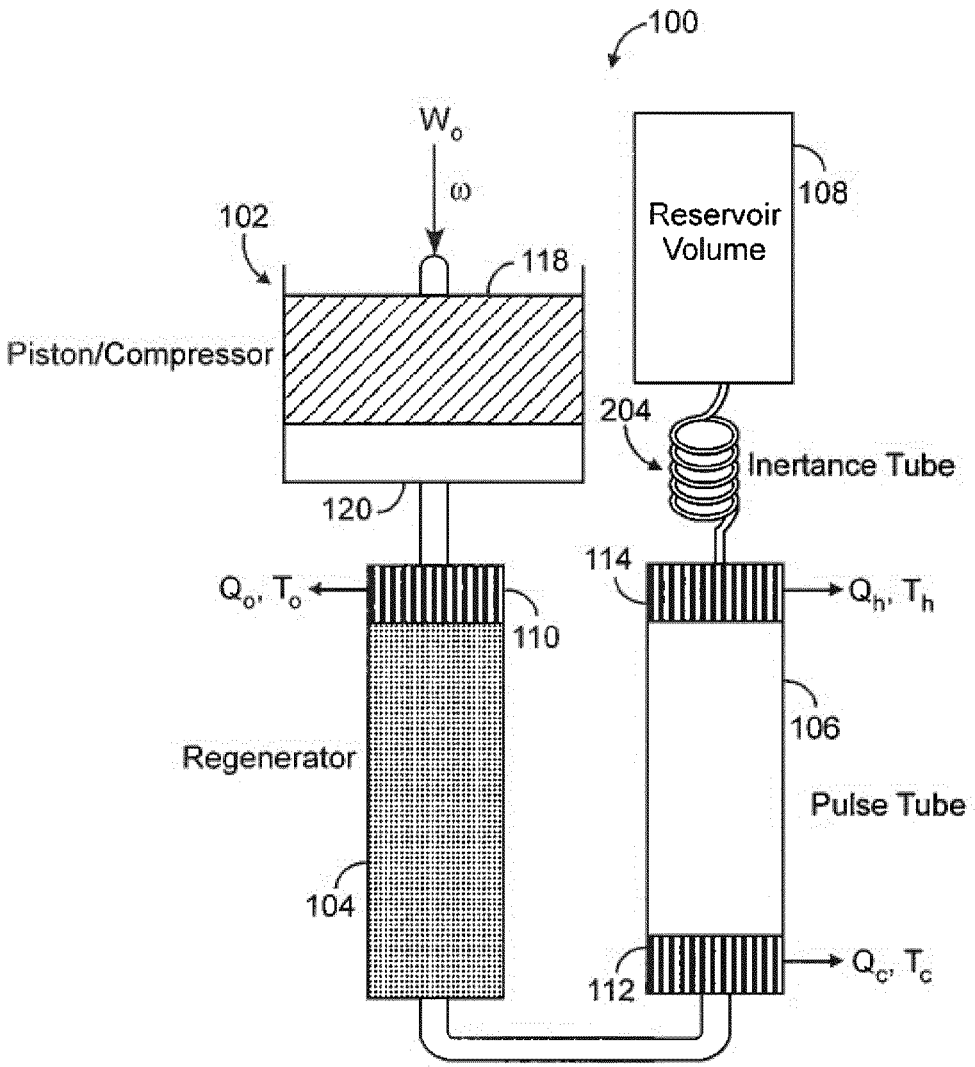
FIG. 3 illustrates one embodiment of the cooler of FIG. 1 where the phase control device comprises an inertance tube

FIG. 3 illustrates one embodiment of the cooler 100 where the phase control device 116 comprises an inertance tube 204. The inertance tube 204 may be several meters in length, which may be coiled, as shown in FIG. 3, or straight. By increasing the distance that the working fluid must traverse between the pulse tube 106 and the reservoir 108, the inertance tube 204 may increase the time that the working fluid takes to reach the reservoir 108, while only minimally affecting the timing of the pressure wave. In this way, the inertance tube 204 may introduce a phase shift between the pressure wave and the mass wave. For the inertance tube geometry shown in FIG. 3, the inertance (L) and flow resistance (R) of the tube 204 may be given by Equations 1 and 2 below where $l_t$, d and v, respectively, are the length, diameter and internal volume of the inertance tube 204.

$$L = \frac{4l_t}{\pi \times d^2} \tag{1}$$

$$R = \frac{128 l_t \eta}{(\pi \times \rho \times d^4)} \tag{2}$$

The inertance tube 204 may be embodied as a portion of the pulse 106, a portion of the reservoir 108, a separate component, or any combination thereof.

Figure 4:
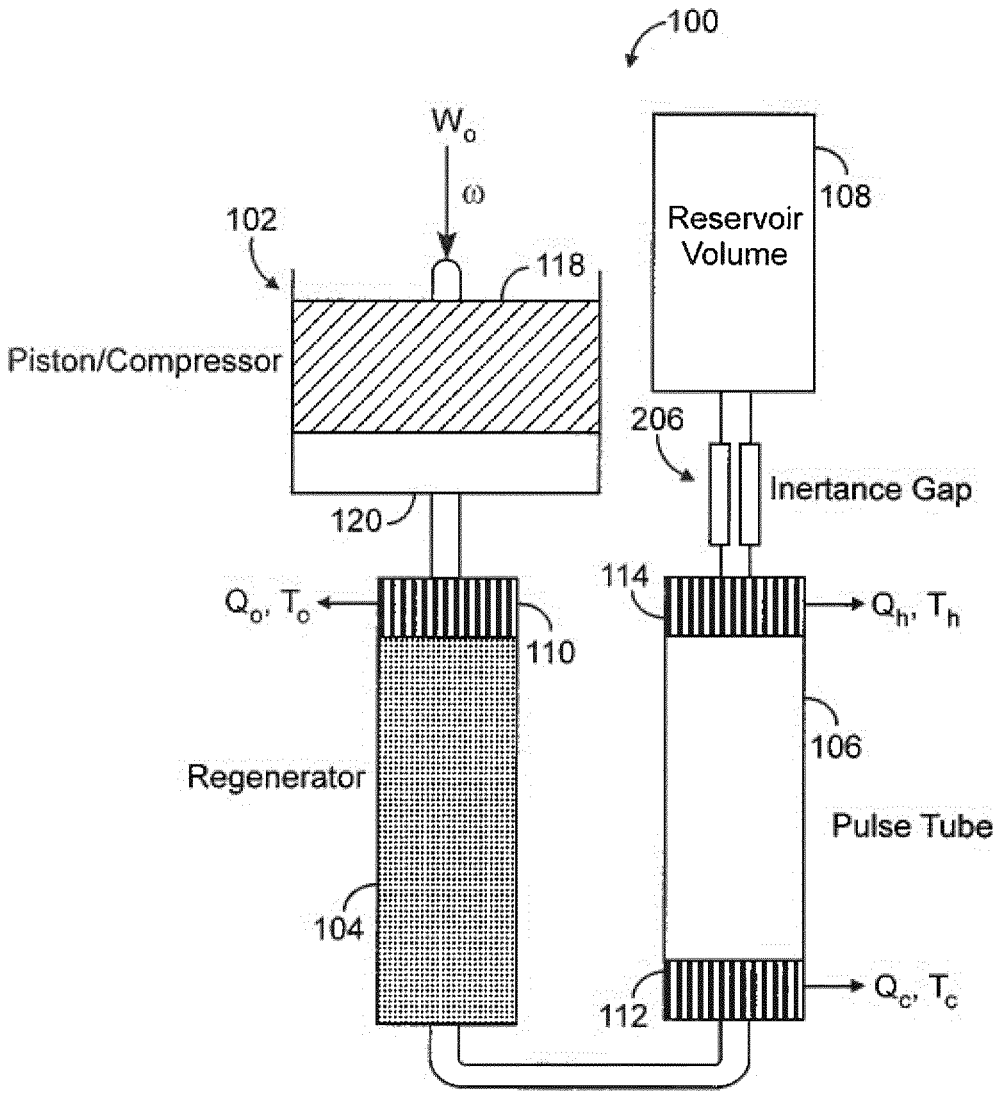
FIG. 4 illustrates one embodiment of the cooler of FIG. 1 where the phase control device comprises an inertance gap device.
Figure 5:
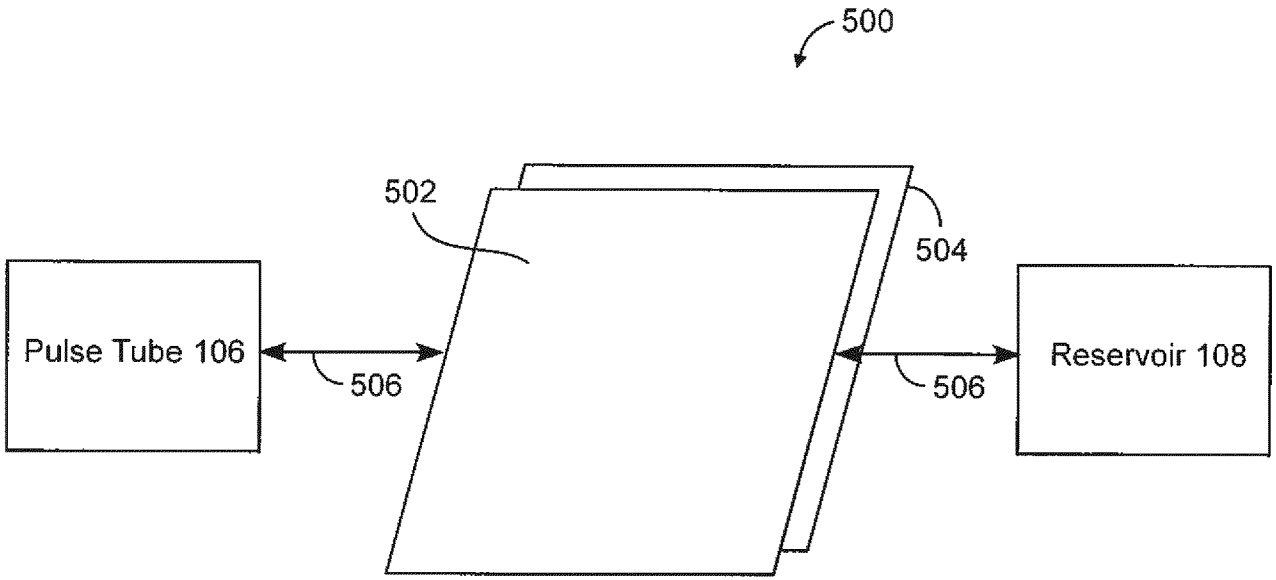
FIG. 5 illustrates one example configuration of an inertance gap device comprising parallel plates.

FIG. 4 illustrates one embodiment of the cooler 100 where the phase control device 116 comprises an inertance gap device 206. The inertance gap device 206 may be a portion of the pulse tube 106, a portion of the reservoir 108, a separate component, or any combination thereof. The inertance gap device 206 may behave similarly to the inertance tube 204, but may have smaller physical dimensions. For example, while the inertance tube 204 may be several meters long, the inertance gap device 206 may have a length on the order of several inches. FIG. 5 illustrates one example configuration of an inertance gap device 500 comprising parallel plates 502, 504. The working fluid of the cooler 100 may pass between the parallel plates 502 as it travels between the pulse tube 106 and the reservoir 108. The path of the working fluid through the inertance gap device 500 is indicated by arrows 506. The inertance and flow resistance of the inertance gap geometry shown in FIG. 5 are given by Equations 3 and 4 below, where $l_g$, w and s are the length, width, and thickness of the gap.

$$L = \frac{l_g}{w \times s} \tag{3}$$

$$R = \frac{12 l_g \eta}{\rho \times w \times s^3} \tag{4}$$

Figure 6:
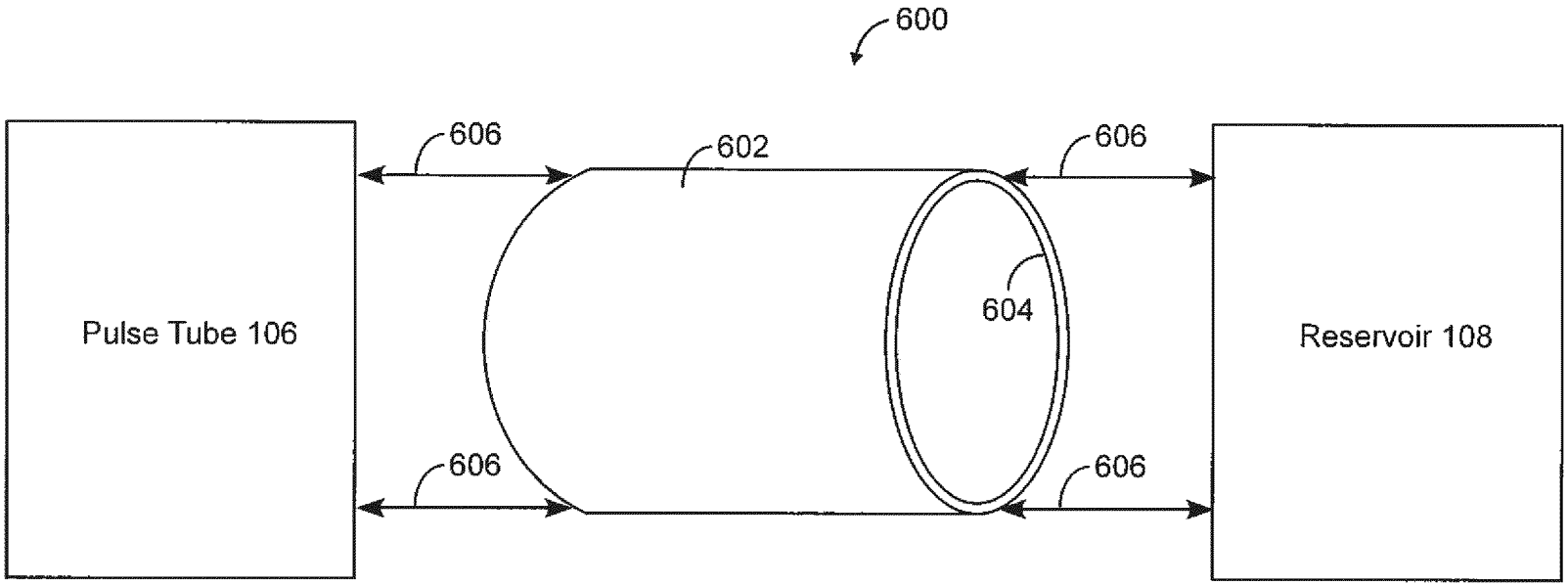
FIG. 6 illustrates one example configuration of an inertance gap device comprising concentric tubes.

FIG. 6 illustrates another example configuration of an inertance gap device 600 comprising concentric tubes 602, 604. The working fluid passes between the tubes on its way from the pulse tube 106 to the reservoir 108 and back. The direction of the working fluid is indicated by arrows 606. The inertance and resistance of the gap geometry shown in FIG. 6 may be a function of the distance between the two concentric tubes 602, 604 and the length of the device 600.

According to various embodiments, the LRC circuit analogy introduced above may be exploited in the design of the phase control device 116 in order to fine tune the performance of the pulse tube cooler 100. For example, instead of comprising just one orifice or just one inertance tube or gap, the phase control device 116 may be constructed from a network of various inertance and flow resistant devices. LRC circuit principles may be used to design networks of inertance and flow resistant deices in order to provide a desired phase shift. Also, because the phase shift of the cooler 100 depends both on the phase control device 116 and the volume of the reservoir 108, modifying the inertance and flow resistance properties of the phase control device 116 may allow the cooler 100 to be constructed with a reservoir 108 having a smaller volume. This may beneficially reduce the total size and weight of the cooler 100.

Figure 7:
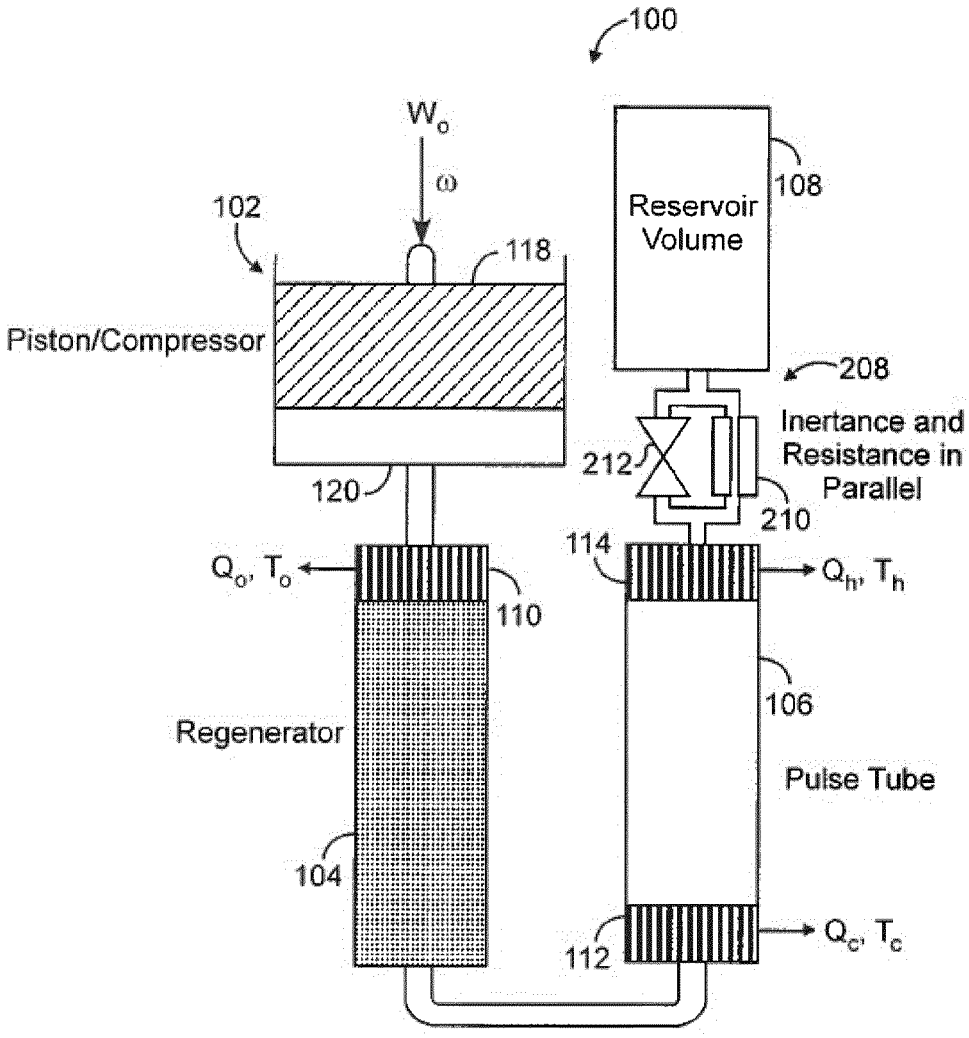
FIG. 7 illustrates one embodiment of the cooler of FIG. 1 where the phase control device is a network comprising an orifice and an inertance device arranged in parallel.

FIG. 7 illustrates one embodiment of the cooler 100 where the phase control device 116 comprises a network 208 comprising an orifice 212 and an inertance device 210 arranged in parallel. In other words, both the inertance device 210 and the orifice 212 have one end in fluid communication with the hot end of the pulse tube 106 and an opposite end in fluid communication with the reservoir 108. The inertance device 210 may be any kind of inertance device including, for example, an inertance tube and/or an inertance gap. The overall flow resistance and inertance of the network 208 may be found according to LRC circuit principles based on the flow resistance of the orifice 212 and the inertance and flow resistance of the inertance device 210. The dimensions and/or other properties of the orifice 212 and the inertance device 210 may be selected to fine tune the phase difference between pressure waves and mass flow waves in the cooler 100. In various embodiments, the network 208 may be designed to provide a desired phase difference (and hence desired cooler performance) with a reservoir volume 108 that is relatively smaller than that which is practically possible with a single element phase control device 116.

Figure 8:
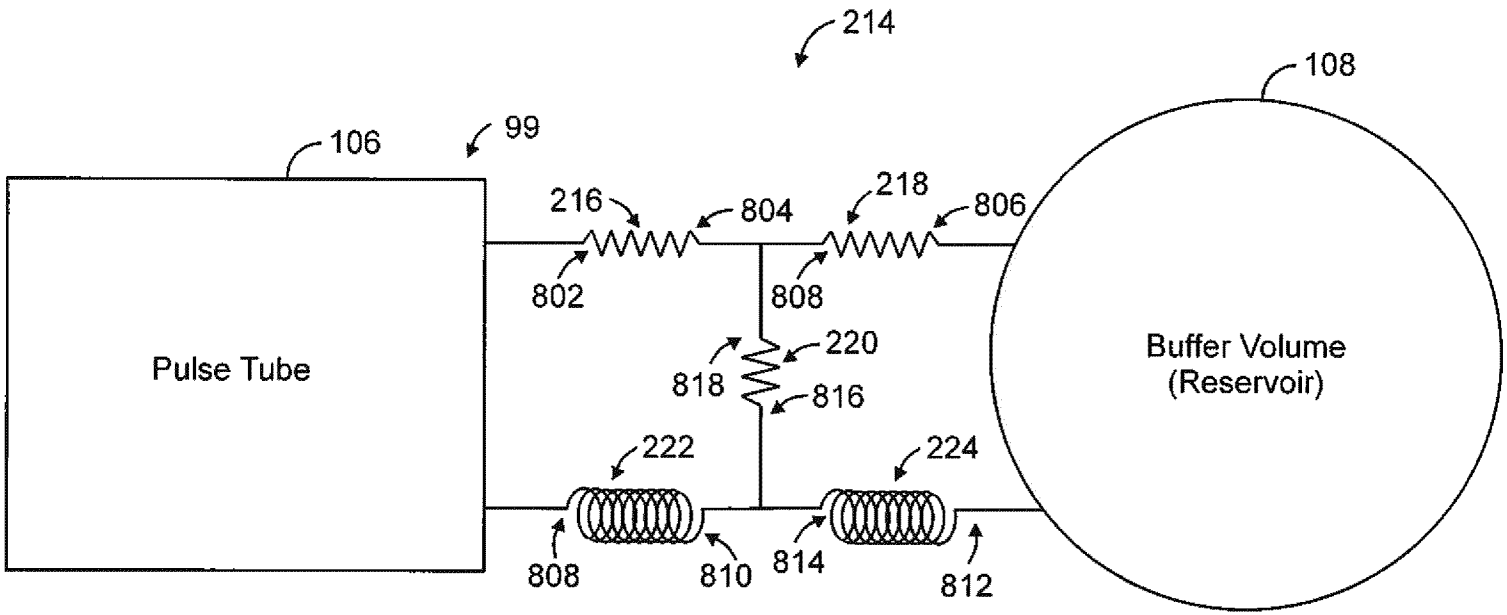
FIG. 8 illustrates a portion of the cooler of FIG. 1 illustrating a network of inertances and flow resistances between the pulse tube and the reservoir.

FIG. 8 illustrates a portion 800 of the cooler 100 illustrating a network 214 of inertances and flow resistances between the pulse tube 106 and the reservoir 108. The network 214 comprises three flow resistive orifices 216, 218, 220 and two inertance devices 222, 224. The inertance devices 222, 224 may be inertance tubes, parallel plate inertance gaps, concentric circle inertance gaps, or any combination thereof. Resistive orifice 216 may have a first end 802 in fluid communication with the cold end 99 of the pulse tube 106 and a second end 804. The resistive orifice 218 may have a first end 806 in fluid communication with the reservoir 108 and a second end 808 in fluid communication with the second end 804 of the orifice 216. The inertance device 222 may have a first end 808 in fluid communication with the cold end 99 of the pulse tube 106 and a second end 810. The inertance device 224 may have a first end 812 in fluid communication with the reservoir 108 and a second end 814 in fluid communication with the second end 810 of the inertance device 222. A resistive orifice 220 may have a first end 816 in fluid communication with the second end 810 of the inertance device 222 and the second end 814 of the inertance device 224. The orifice 220 may also have a second end 818 in fluid communication with the second end 804 of the orifice 216 and the second end 808 of the orifice 218.

It will be appreciated that the sizes and values of the inertance devices 222, 224 and the flow resistive orifices 216, 218, 220 may be optimized based on the size of various other components (e.g., the regenerator 104, pulse tube 106 and reservoir 108) and on the operating conditions. In one embodiment, the regenerator 104 may be 20.8 centimeters (cm) long with a diameter of 3.95 cm. The pulse tube 106 may be 20.13 cm long with a diameter of 2.54 cm. The inertance device 222 may be a concentric gap with a diameter of 1.297 cm, a length of 6.3 cm and a gap width of 23.59 microns. The inertance device 224 may also be a concentric gap with a diameter of 2.54 cm, a length of 7 cm and a gap width of 100 microns. The orifice 216 may have a diameter of $7.103 \times 10^{-4}$ meters. The orifice 218 may have a diameter of $12.12 \times 10^{-4}$ meters. Also, the orifice 220 may have a diameter of $1.869 \times 10^{-4}$ meters.

Figure 9:
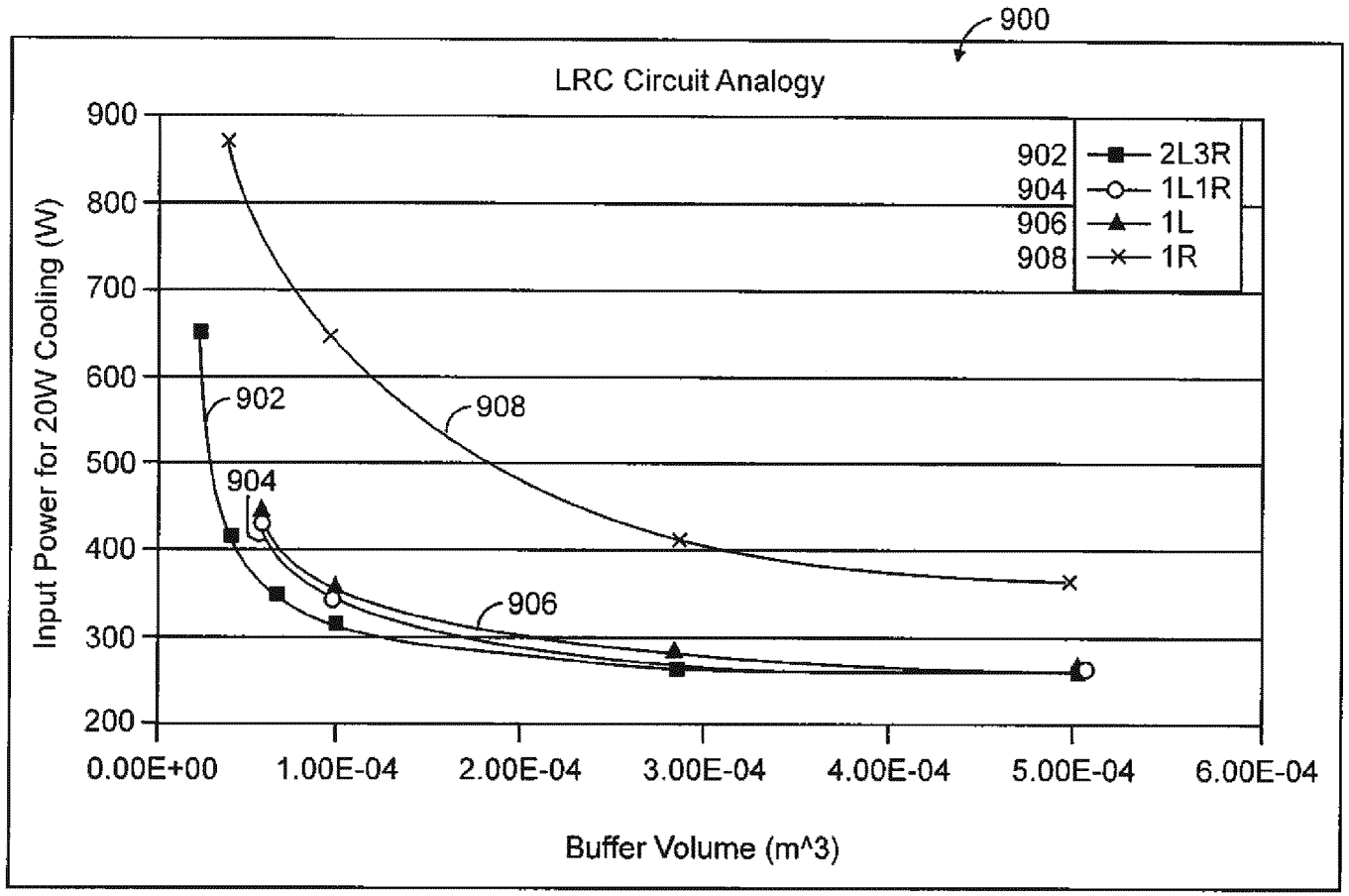
FIG. 9 is a chart illustrating cooler efficiency (y-axis) as a function of reservoir volume (x-axis).

FIG. 9 is a chart 900 illustrating cooler efficiency (y-axis) as a function of reservoir volume (x-axis). The chart 900 was generated by modeling various embodiments of the cooler 100 using the SAGE software package available from Gedeon Associates of Athens, Ohio. On the y-axis, cooler efficiency is represented as an input power necessary to bring about 20 Watts of cooling. Reservoir volume is represented on the x-axis in cubic meters. All of the plots 902, 904, 906, 908 shown in FIG. 9 were modeled as including (i) a regenerator with a diameter of 3.95 centimeters (cm) and a length of 20.8 cm, and (ii) a pulse tube with a diameter of 2.54 cm and a length of 20.13 cm. Each of the plots 902, 904, 906, 908 corresponds to a different configuration of the phase control device 116. Plot 908 shows results of the embodiment of the cooler 100 shown in FIG. 2 where the phase control device 116 comprises a single flow resistive orifice 202. The diameter of the single flow resistive orifice 202 was optimized for the component dimensions above by the SAGE software package. Plot 906 shows results of the embodiment of the cooler 100 shown in FIGS. 3 and 4 where the phase control device 116 comprises a single inertance device, which may be an inertance tube or any kind of inertance gap. The dimensions of the inertance gap were optimized for the component dimensions above by the SAGE software package. Plot 904 shows results of the embodiment of the cooler 100 shown in FIG. 7 having an inertance device (e.g., a tube or gap) and a resistive orifice in parallel. The dimensions of the inertance and resistance devices were optimized for the component dimensions above by the SAGE software package. Plot 902 shows results of the embodiment of the cooler 100 shown in FIG. 8 having the network 214 of inertances and resistances as shown with the dimensions set forth above with respect to FIG. 8. It can be seen that plot 904 corresponding to the embodiment shown in FIG. 7 and plot 902 corresponding to the embodiment shown in FIG. 8 provide superior efficiency, with the plot 902 demonstrating superior efficiency over the range of reservoir volumes modeled, especially at smaller reservoir volumes.

During the thermodynamic cycle of a pulse tube cooler, such as the cooler 100 described above, the properties of the various components including, for example, the temperature of the working fluid, may change. This may, in turn, cause changes to the performance of the cooler including, for example, changes to the inertance and flow resistance of various components of the phase control device. Increased performance of the cooler, therefore, may be obtained by varying the inertance and/or flow resistance of the phase control device during the thermodynamic cycle of the cooler.

Figure 10:
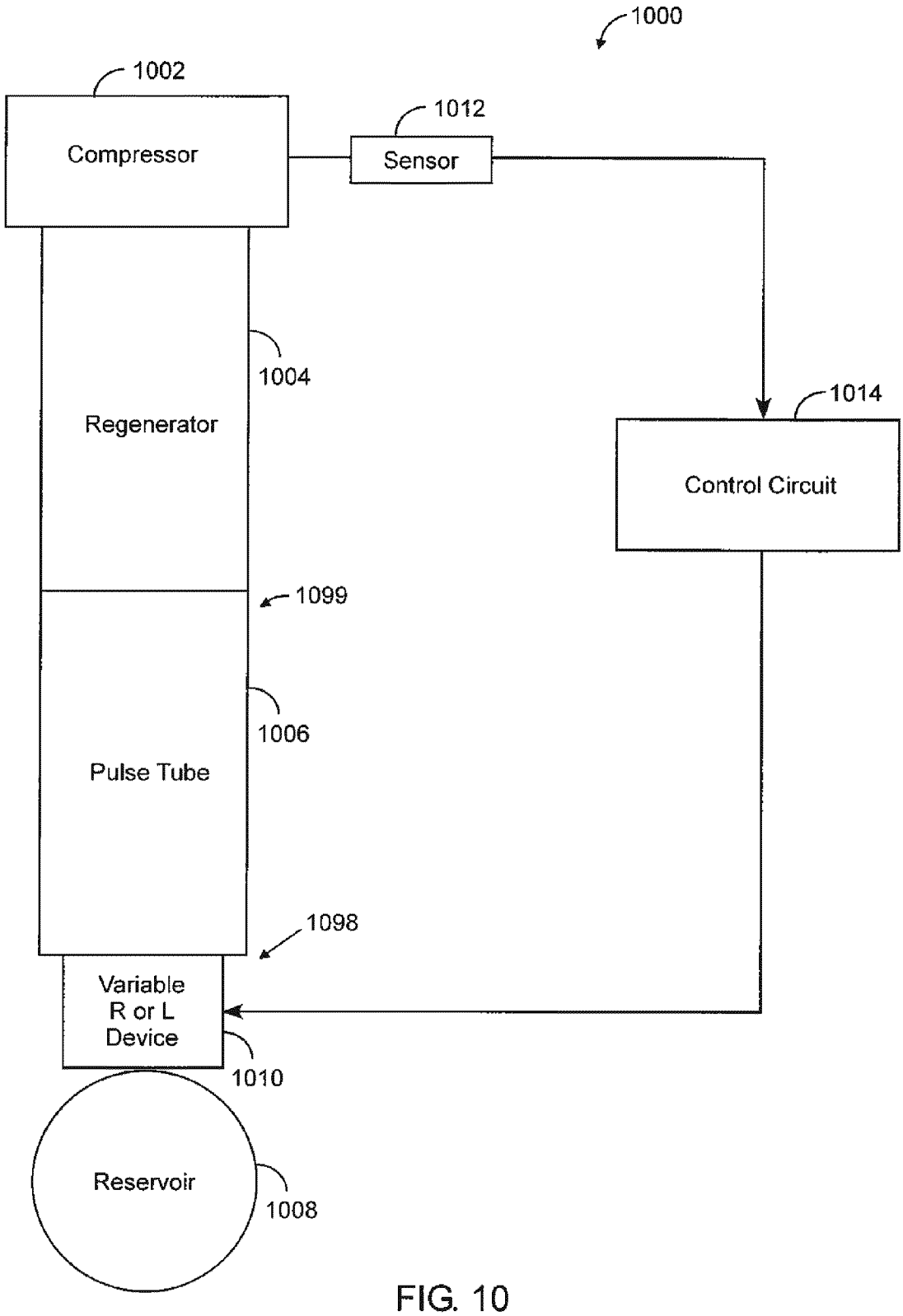
FIG. 10 illustrates one embodiment of a pulse tube cooler with a variable phase control device configured to vary the flow resistance and/or inertance of the phase control device during the thermodynamic cycle of the cooler.

FIG. 10 illustrates one embodiment of a pulse tube cooler 1000 configured to vary the flow resistance and/or inertance of the phase control device 1010 during the thermodynamic cycle of the cooler 1000. The cooler 1000 may comprise a compressor 1002, a regenerator 1004, a pulse tube 1006 and a reservoir 1008. These components may operate, for example, as described above. For example, the pulse tube 1006 may have a cold end 1099 and a hot end 1098. The variable phase control device 1010 may be any device having a variable inertance or flow resistance. The inertance and/or flow resistance of the device 1010 may be controllable. Examples of such devices are described below with reference to FIGS. 11-13, 14A and 14B. A control circuit 1014 may control the inertance and/or flow resistance of the device 1010.

The control circuit 1014 may be in communication with one or more sensors 1012 that may capture data indicative of the position of the cooler 1000 in its thermodynamic cycle. For example, the position of the compressor 1002 may track the position of the cooler 1000 in its thermodynamic cycle. Accordingly, the sensor 1012 may be positioned to sense the position of the compressor 1002. For example, when the compressor 1002 is a piston-driven compressor, the sensor 1012 may track the position of the piston and/or a motor driving the piston. Also, for example, the sensor 1012 may sense the pressure at different positions of the compressor 1002 and, thereby, indirectly track the position of the compressor 1002. According to various embodiments, the sensor 1012 may track the position of the cooler 1000 in its thermodynamic cycle in other ways. For example, the sensor 1012 may monitor the temperature, pressure and/or mass flow at different portions of the regenerator 1004, pulse tube 1006 and/or reservoir 1008. In operation, the control circuit 1014 may vary the resistance and/or inertance of the phase control device 1010 based on the position of the cooler 1000 in its thermodynamic cycle. For example, the control circuit 1014 may vary the resistance and/or inertance of the phase control device 1010 periodically based on a period of the thermodynamic cycle of the cooler 1000. For example, the period of the phase control device 1010 may be equal to the period of the thermodynamic cycle of the cooler 1000. Also, for example, in some embodiments, the period of the phase control device 1010 may be a multiple of the period of the thermodynamic cycle of the cooler 1000. The multiple may be greater than or less than one. In various embodiments, the sensor 1012 may be omitted. The period of the thermodynamic cycle of the cooler 1000 may be known and the control circuit 1014 may drive the phase control device 1010 at a period equal to the known thermodynamic cycle of the cooler 1000. The cooler 1000 may be calibrated so that any phase differences between the period of the phase control device 1010 and the cooler 100 may be reduced or eliminated.

The control circuit 1014 may comprise any suitable form of analog or digital control device or devices. According to various embodiments, the control circuit 1014 may comprise one or more digital processor with associated memory. The memory may comprise instructions that, when executed by the one or more digital processors, cause the control circuit 1014 to control the inertance and/or flow resistance of the phase control device 1010 as described herein.

Figure 11:
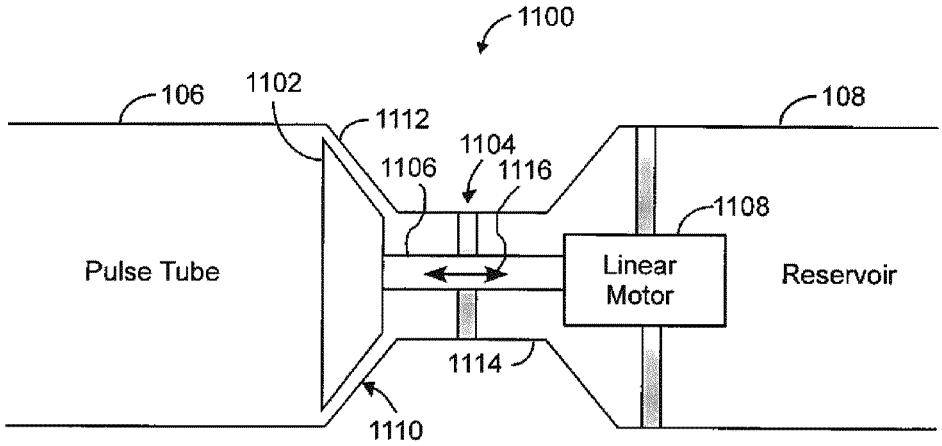
FIG. 11 illustrates one embodiment of a variable inertance device.
Figure 12:
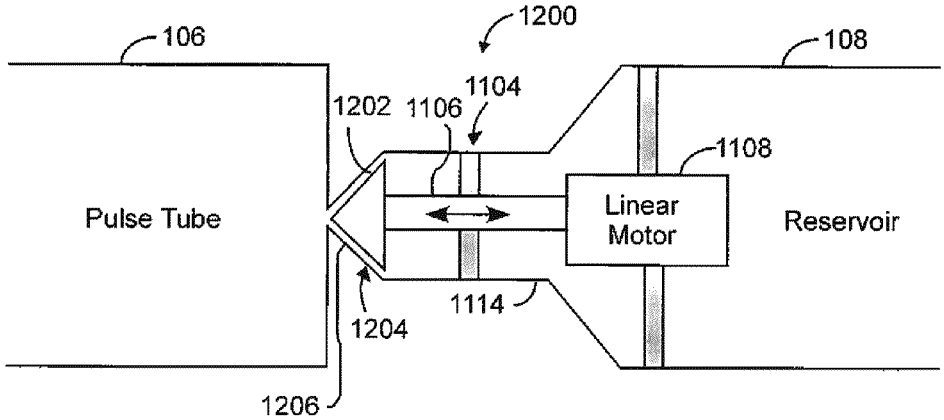
FIG. 12 illustrates another embodiment of a variable inertance device.

FIG. 11 illustrates one embodiment of a variable inertance device 1100 that may be controlled by the control circuit 1014. As illustrated, the device 1100 is positioned between and partially within the pulse tube 106 and the reservoir 108. A spacer 1114 may be positioned between the reservoir 108 and the pulse tube 106. A flange 1112 may be positioned at a transition between the pulse tube 106 and the spacer 1114. A plunger 1102 may be positioned within the flange 1112. The plunger 1102 and the flange 1112 may define a gap 1110 between them that may serve as an inertance gap. The size of the gap 1110 may change as the plunger 1102 moves in and out with respect to the flange 1112. Accordingly, the inertance and flow resistance of the gap 1110 may vary depending on the position of the plunger 1102. A linear motor 1108 may provide motive force to translate the plunger 1102 back and forth within the flange 1112 in the direction of arrow 1116 based on a control signal received from the control circuit 1014. FIG. 12 illustrates another embodiment of a variable inertance device 1200. The device 1200 may operate in a manner similar to that of the device 1100 described above. Flange 1206 and plunger 1202 of the device 1200, however, have shapes that narrow towards the pulse tube 106, giving the device 1200 different flow resistance and inertance properties than the device 1100 for a given gap size.

Figure 13:
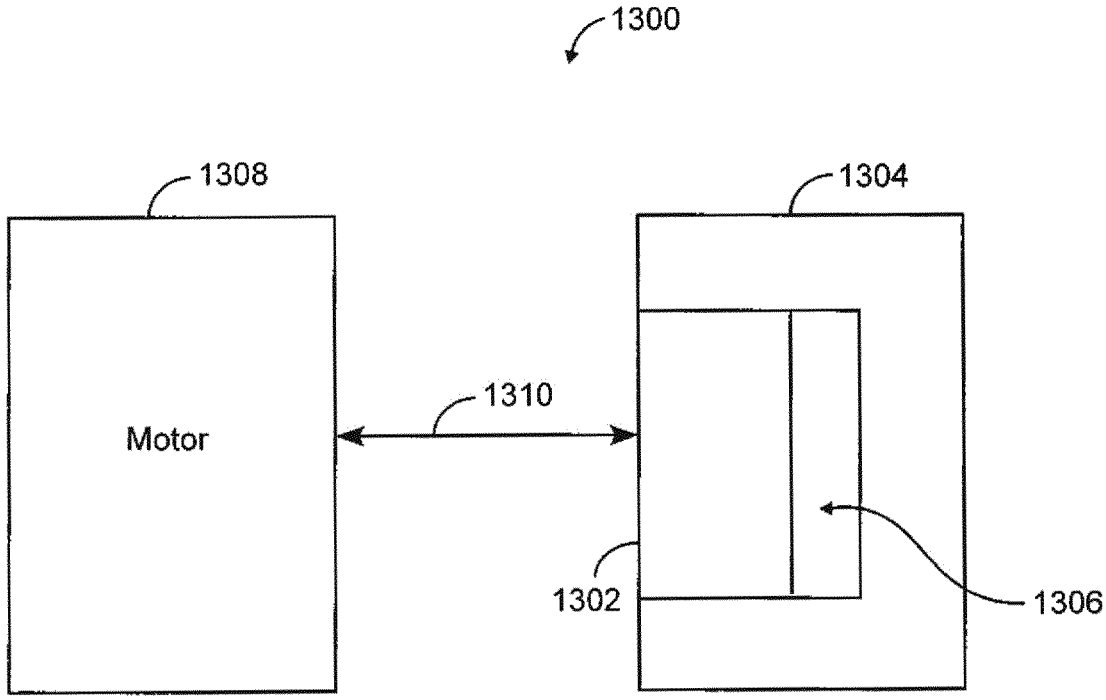
FIG. 13 illustrates one embodiment of a variable inertance gap device.

FIG. 13 illustrates one embodiment of a variable inertance gap device 1300. The device 1300 comprises a piston 1302 and a housing 1304 that collectively define an inertance gap 1306. A motor 1308 (e.g., a linear motor) may drive the piston 1302 back and forth in the direction of the arrow 1310 based on a control signal received from the control circuit 1014, thus alternately enlarging and contracting the inertance gap 1306. The device 1300 is illustrated in cross section, such that working fluid would flow between the pulse tube 106 and the reservoir 108 through the gap 1306 in a direction into and out of the page. Accordingly, as the piston 1302 is moved to change the diameter of the gap 1306, the inertance and resistance of the device 1300 may change.

Figure 14A:
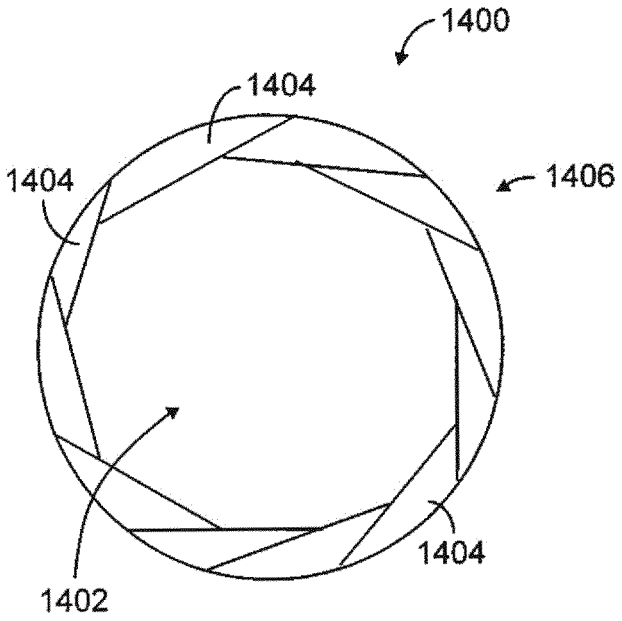
FIG. 14A illustrates one embodiment of a variable flow resistant device in a low resistance configuration.
Figure 14B:
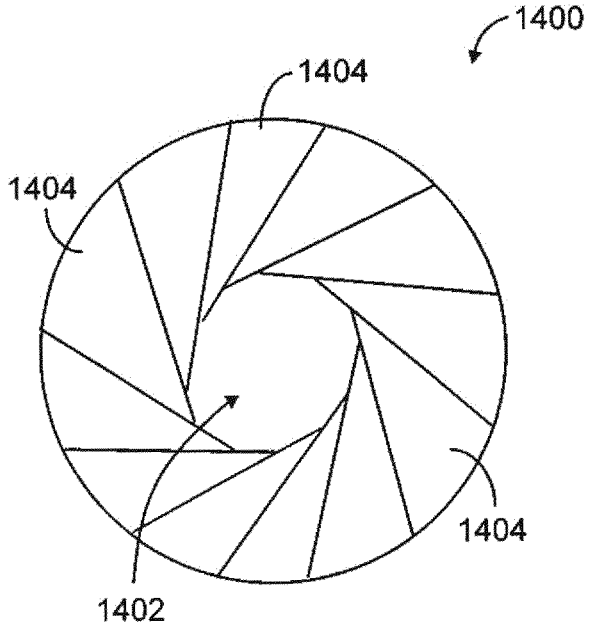
FIG. 14B shows the device of FIG. 14A in a higher flow resistance configuration.

FIG. 14A illustrates one embodiment of a variable flow resistance device 1400 in a low resistance configuration. The device 1400 comprises a ring 1406 made up of shaped plates 1404 capable of sliding over one another and defining an orifice 1402. The size of the orifice 1402 may define the flow resistance of the device, with larger orifice sizes corresponding to lower flow resistances. FIG. 14B shows the device 1400 in a higher flow resistance configuration. As illustrated, the plates 1404 have slid over one another causing the size of the orifice 1402 to be reduced. The device 1400 may be transitioned from the low flow resistance configuration shown in FIG. 14A to the high flow resistance configuration shown in FIG. 14B by any suitable mechanism based on a control signal received from the control circuit 1014. For example, the device 1400 may operate in a manner similar to that of mechanical irises used in the optical arts. Motive force to change the diameter of the orifice 1402 may be provided by any suitable device including, for example, a stepper motor (not shown).

Figure 15:
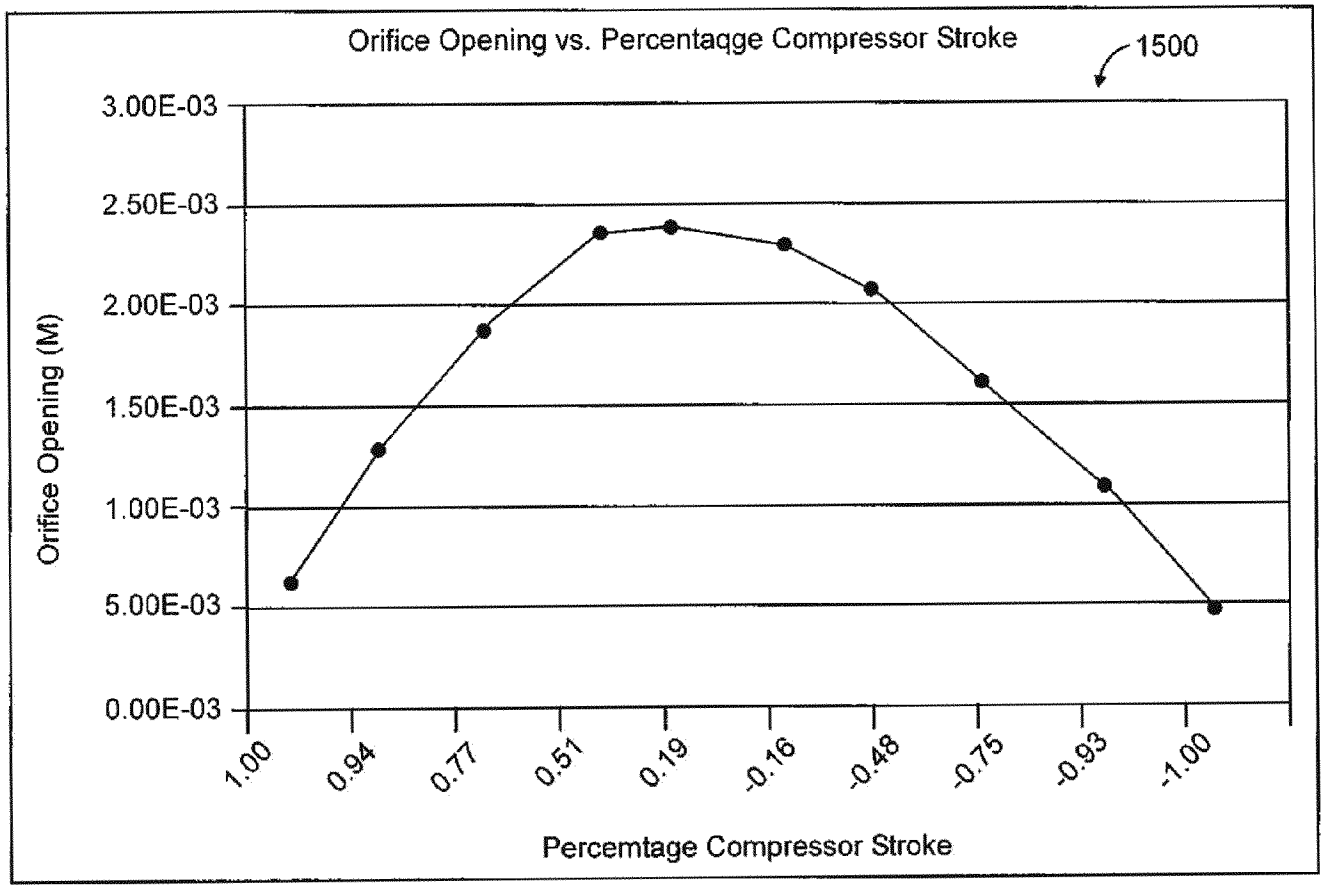
FIG. 15 is a chart showing a plot of orifice diameter versus compressor stroke position that was used in a model of the cooler of FIG. 10.

The pulse tube cooler 1000 was modeled using the SAGE software described above. Three configurations were modeled. In a first configuration, the phase control device 1010 was modeled as a fixed diameter (e.g., non-varying) orifice. The SAGE software package was utilized to optimize the fixed diameter based on the dimensions of the other components. In a second configuration, the phase control device 1010 was modeled as a fixed inertance tube. Again, the SAGE software package was utilized to optimize the fixed inertance based on the dimensions of the other components. In a third configuration, the phase control device 1010 was a variable diameter orifice device similar to the device 1400 shown in FIG. 14. The diameter of the orifice opening was varied with the stroke of the compressor. FIG. 15 is a chart showing a plot 1500 of orifice diameter versus compressor stroke position that was used in the model. In all of the modeled configurations, the regenerator 1004 was 3.144 cm in length and 0.6185 cm in diameter. Also, in all of the modeled configurations, the pulse tube 1006 was 3.144 cm in length and 0.5396 cm in diameter.

Figure 16:
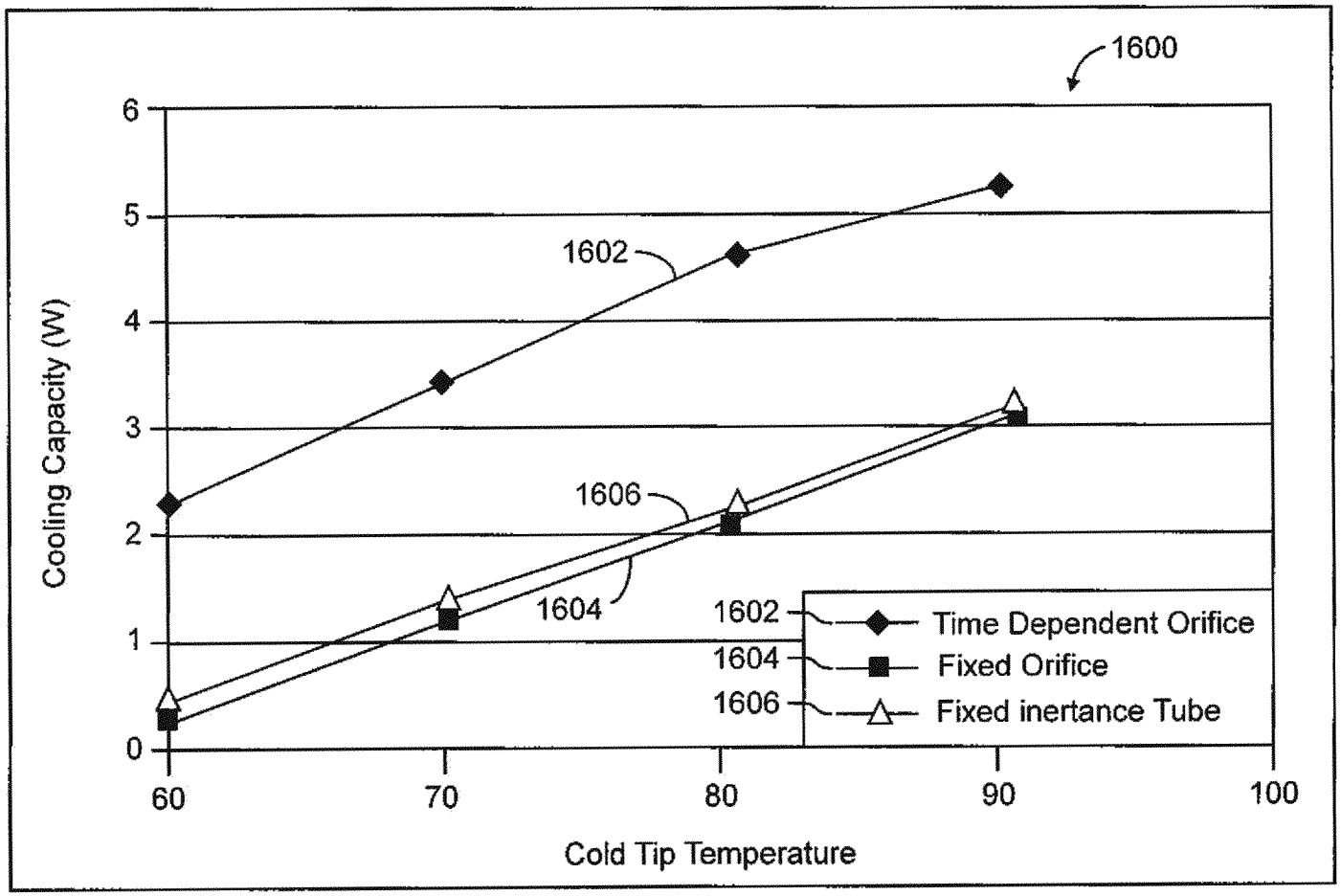
FIG. 16 is a chart illustrating the results of the model of the cooler of FIG. 10.

FIG. 16 is a chart 1600 illustrating the results of the model. The chart 1600 shows cold tip temperature at the cold end 1099 of the pulse tube 1006 on the x-axis and cooling capacity in Watts on the y-axis. Curves 1604 and 1606 show the results of the fixed orifice configuration and the fixed inertance configuration, respectively. Curve 1602 shows the results of the variable orifice configuration. It can be seen that across the full range of tested cold tip temperatures, the cooling capacity of the variable orifice configuration was greater than that of either of the fixed configurations. Although the described model tested only a variable flow resistance configuration, it is believed that similarly positive results would be obtained by utilizing a variable inertance device including, for example, those described above with respect to FIGS. 11-13.

According to various embodiments, a flow resistance device network, such as the networks 208, 214 shown in FIGS. 7 and 8 may comprise one or more variable phase control devices. The variable phase control devices may have a variable inertance and/or a variable flow resistance. The flow resistance and or inertance of the variable phase control devices may be varied periodically within the thermodynamic cycle of the pulse tube cooler, for example, as described above with reference to FIG. 10.

Figure 17:
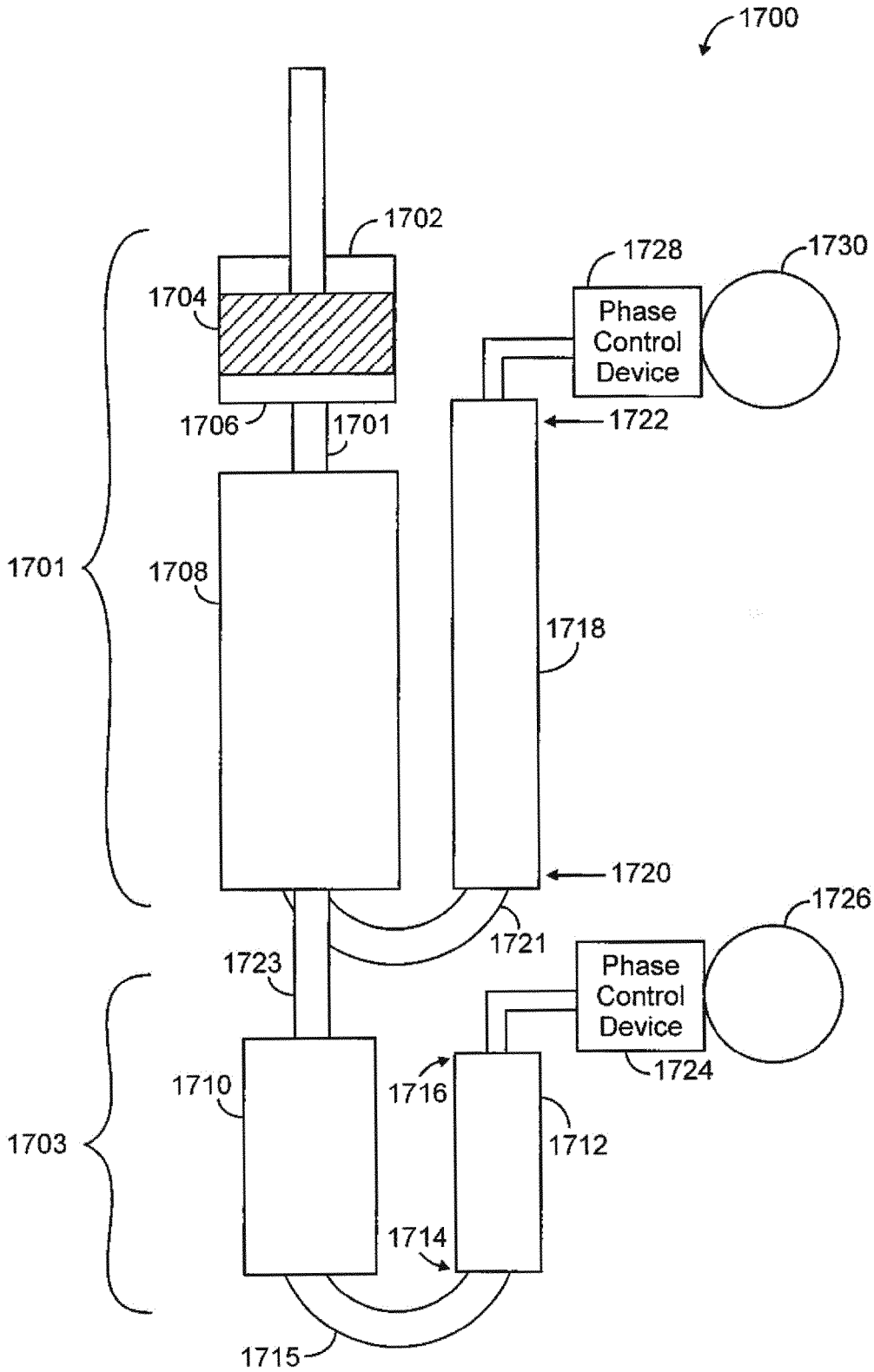
FIG. 17 illustrates one embodiment of a multistage pulse tube cooler with two stages.

According to various embodiments, the techniques described herein may be implemented in a multistage cooler. FIG. 17 illustrates one embodiment of a multistage pulse tube cooler with two stages, 1701, 1703. A compressor 1702 may comprise a piston 1706 and a cylinder 1706. The first stage 1701 comprises a first stage regenerator 1708, a first stage reservoir 1730 and a first stage pulse tube 1718 having a cold end 1720 and a hot end 1722. The compressor 1702 and the first stage regenerator may be in fluid communication with one another, for example, via a tube 1701. The pulse tube 1718 and reservoir 1730 are connected via a first stage phase control device 1728. The second stage 1703 may comprise a second stage regenerator 1710, a second stage reservoir 1726 and a second stage pulse tube 1712, which may have a hot end 1716 and a cold end 1714. The cold end 1714 of the second stage pulse tube 1712 may be in fluid communication with the second stage regenerator 1710, for example, via tube 1715. The second stage pulse tube 1712 and the second stage reservoir 1726 may also be connected via a phase control device 1724. The cold end 1720 of the first stage pulse tube 1718 may be in fluid communication with the second stage regenerator 1710. For example, in the embodiment shown in FIG. 17, the cold end 1720 of the first stage pulse tube 1718 is connected to the second stage regenerator via tubes 1721 and 1723. Although only two stages are shown, it will be appreciated that coolers may be constructed with an arbitrary number of stages.

In the multistage cooler 1700 shown in FIG. 17, the phase control devices 1728 and/or 1724 may be configured as described above. For example, one or both of the phase control devices 1728, 1724 may comprise a network of flow resistive orifices and/or inertance devices. Also, for example, one or both of the phase control devices 1728, 1724 may comprise at least one flow resistive orifice and/or inertance device having an resistance and/or inertance that varies with time, for example, based on the thermodynamic cycle of the cooler 1700 as described above. It will be appreciated that when coolers having more thin two stages are used, the respective phase control devices of the different phases may also comprise a network of devices and/or a variable device, as described.

It is to be understood that the figures and descriptions of the present invention have been simplified to illustrate elements that are relevant for a clear understanding of the present invention, while eliminating other elements, for purposes of clarity. Those of ordinary skill in the art will recognize that these and other elements may be desirable. However, because such elements are well known in the art and because they do not facilitate a better understanding of the present invention, a discussion of such elements is not provided herein.

In general, it will be apparent to one of ordinary skill in the art that at least some of the embodiments described herein, such as those including the control circuit 1014, may be implemented utilizing many different embodiments of software, firmware, and/or hardware. The software and firmware code may be executed by a computer or computing device comprising a processor (e.g., a DSP or any other similar processing circuit). The processor may be in communication with memory or another computer readable medium comprising the software code. The software code or specialized control hardware that may be used to implement embodiments is not limiting. For example, embodiments described herein may be implemented in computer software using any suitable computer software language type, using, for example, conventional or object oriented techniques. Such software may be stored on any type of suitable computer-readable medium or media, such as, for example, a magnetic or optical storage medium. According to various embodiments, the software may be firmware stored at an EEPROM and/or other non-volatile memory associated with a DSP or other similar processing circuit. The operation and behavior of the embodiments may be described without specific reference to specific software code or specialized hardware components. The absence of such specific references is feasible, because it is clearly understood that artisans of ordinary skill would be able to design software and control hardware to implement the embodiments based on the present description with no more than reasonable effort and without undue experimentation.

In various embodiments disclosed herein, a single component may be replaced by multiple components and multiple components may be replaced by a single component to perform a given function or functions. Except where such substitution would not be operative, such substitution is within the intended scope of the embodiments.

While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

We claim:

1. A pulse tube cooler comprising:

a compressor;

a regenerator having a first end and a second end, wherein the regenerator is in fluid communication with the compressor at the first end;

a pulse tube having a cold end and a hot end, wherein the pulse tube is in fluid communication with the regenerator at the cold end;

a reservoir, wherein the reservoir is in fluid communication with the pulse tube at the hot end of the pulse tube;

a working fluid positioned within the regenerator, the pulse tube, and the reservoir; and a variable phase control device positioned in a fluid path between the hot end of the pulse tube and the reservoir, the pulse tube cooler having a thermodynamic cycle defined by the flow of working fluid into and out of the regenerator, pulse tube and reservoir; and a control circuit in communication with the variable phase control device, wherein the control circuit is programmed to vary a characteristic of the variable phase control device based on the position of the pulse tube cooler in its thermodynamic cycle.

2. The pulse tube cooler of claim 1, wherein the characteristic of the variable phase control device is an inertance.

3. The pulse tube cooler of claim 1, wherein the characteristic of the variable phase control device is a flow resistance.

4. The pulse tube cooler of claim 1, wherein the variable phase control device comprises a plunger positioned within a flange, wherein the plunger and flange define a gap there between and where the size of the gap is variable based on a position of the plunger with respect to the flange on an axis parallel to the direction of working fluid flow between the pulse tube and the reservoir.

5. The pulse tube cooler of claim 4, wherein the plunger and the flange have shapes that widen towards the pulse tube.

6. The pulse tube cooler of claim 4, wherein the plunger and the flange have shapes that narrow towards the pulse tube.

7. The pulse tube cooler of claim 1, wherein the variable phase control device comprises:

a housing;

a piston positioned within the housing, wherein the piston and the housing define a gap there between where the size of the gap is variable based on a distance between the piston and the housing on an axis perpendicular to the direction of working fluid flow between the pulse tube and the reservoir; and a motor positioned to translate the piston relative to the housing.

8. The pulse tube cooler of claim 7, wherein the variable phase control device comprises a device defining an orifice with a variable diameter.

9. The pulse tube cooler of claim 1, further comprising a sensor positioned to capture data indicative of a position of the pulse tube cooler in the thermodynamic cycle, wherein the control circuit is further programmed to determine the position of the pulse tube cooler in its thermodynamic cycle based on the data received from the sensor.

10. The pulse tube cooler of claim 9, wherein the data indicative of the position of the pulse tube cooler in its thermodynamic cycle comprises at least one of data indicating a position of a piston of the compressor and data indicating a pressure of the working fluid proximate the compressor.

11. The pulse tube cooler of claim 9, wherein the data indicative of the position of the pulse tube cooler in the thermodynamic cycle comprises data indicating at least one of a temperature, a pressure, and a mass flow at the first end of the regenerator.

12. The pulse tube cooler of claim 9, wherein the data indicative of the position of the pulse tube cooler in the thermodynamic cycle comprises data indicating at least one of a temperature, a pressure, and a mass flow at the cold end of the pulse tube.

13. The pulse tube cooler of claim 9, wherein the data indicative of the position of the pulse tube cooler in the thermodynamic cycle comprises data indicating at least one of a temperature, a pressure, and a mass flow at the hot end of the pulse tube.

14. The pulse tube cooler of claim 1, wherein the control circuit is programmed to vary a characteristic of the variable phase control device based on the position of the pulse tube cooler in its thermodynamic cycle by varying at least one of an inertance of the variable phase control device and a flow resistance of the variable phase control device according to a first period.

15. The pulse tube cooler of claim 14, wherein the first period is equal to a period of the thermodynamic cycle of the pulse tube cooler.

16. The pulse tube cooler of claim 14, wherein the first period is a multiple of a period of the thermodynamic cycle of the pulse tube cooler.

17. A method of operating a pulse tube cooler, the method comprising:

varying a characteristic of a variable phase control device based on the position of the pulse tube cooler in a thermodynamic cycle of the pulse tube cooler, wherein the thermodynamic cycle is defined by the flow of a working fluid into and out of a regenerator, a pulse tube and a reservoir of the pulse tube cooler, and wherein the variable phase control device is positioned between a pulse tube of the pulse tube cooler and a reservoir of the pulse tube cooler.

18. The method of claim 17, wherein the characteristic of the variable phase control device is an inertance.

19. The method of claim 17, wherein the characteristic of the variable phase control device is a flow resistance.

20. The method of claim 17, further comprising varying the characteristic of the variable phase control device according to a first period selected from the group consisting of a period of the thermodynamic cycle of the pulse tube cooler and a multiple of the period of the thermodynamic cycle of the pulse tube cooler.

21. The method of claim 17, further comprising receiving from a first sensor data indicating a position of a pulse tube cooler in a thermodynamic cycle of the pulse tube cooler; and determining the position of the pulse tube cooler in its thermodynamic cycle based on the data.

22. A computer readable medium comprises instructions thereon that, when executed by at least one processor, cause the at least one processor to:

vary a characteristic of a variable phase control device based on the position of the pulse tube cooler in a thermodynamic cycle of the pulse tube cooler, wherein the thermodynamic cycle is defined by the flow of a working fluid into and out of a regenerator, a pulse tube and a reservoir of the pulse tube cooler, and wherein the variable phase control device is positioned between a pulse tube of the pulse tube cooler and a reservoir of the pulse tube cooler.

23. The computer readable medium of claim 22, further comprising instructions thereon that, when executed by the at least one processor, cause the at least one processor to receive from a first sensor data indicating a position of a pulse tube cooler in a thermodynamic cycle of the pulse tube cooler; and determine the position of the pulse tube cooler in its thermodynamic cycle based on the data.

* * * * *